US005782213A

United States Patent [19]

Pedersen

[11] Patent Number: 5,782,213

[45] Date of Patent: Jul. 21, 1998

[54] INTERNAL COMBUSTION ENGINE

[76] Inventor: Laust Pedersen, 21291 High Country Dr., Trebuco Canyon, Calif. 92679

[21] Appl. No.: 835,293

[22] Filed: Apr. 7, 1997

[51] Int. Cl.[6] ..... F02B 75/22

[52] U.S. Cl. ..... 123/55.2; 123/197.4

[58] Field of Search ..... 123/197.3, 197.4, 123/55.5, 55.7, 55.2, 54.2

[56] References Cited

U.S. PATENT DOCUMENTS

| | | | |
|---|---|---|---|
| 4,641,611 | 2/1987 | Stiller et al. | 123/55.7 |
| 4,682,569 | 7/1987 | Stiller et al. | 123/55.7 |
| 5,189,994 | 3/1993 | Gindentuller | 123/197.4 |
| 5,503,038 | 4/1996 | Aquino et al. | 123/55.5 |

*Primary Examiner*—Marguerite McMahon
*Attorney, Agent, or Firm*—Steins & Associates

[57] ABSTRACT

An improved internal combustion engine is disclosed. The disclosed engine comprises several preferred embodiments, each including a first piston reciprocating in a first cylinder along a first axis, a second piston reciprocating in a second cylinder along a second axis, said second axis being orthagonal to said first axis, and a flying crankshaft orbiting around a third axis, said third axis being orthagonal to said first and second axis'. Also disclosed are two opposing piston-pairs, reciprocating in cylinders along said first and second axis', each piston in a pair connected to the other piston by a connecting means further defined by a crank aperture within which said flying crankshaft orbits. The disclosed engine further may include at least one ring bearing and/or at least one ring gear within which said crankshaft orbits. This disclosed configuration dynamically dissipates substantially all of the side load forces between the pistons and cylinders created by combustion, as well as efficiently captures the inertia and centrifugal forces created by the pistons and associated members. As disclosed, the present invention will provide an internal combustion engine or the like which is more efficient and reduces piston and cylinder wear. The disclosed engine is lightweight, compact, and dynamically balanced. The present invention discloses embodiments comprising both intersecting and non-intersecting cylinder axis', and further embodiments having 2, 3 or 4 pistons.

20 Claims, 7 Drawing Sheets

INTERNAL COMBUSTION ENGINE

BACKGROUND OF THE INVENTION

1. Field of the Invention

This invention relates generally to engines and, more specifically, to internal combustion engines comprising opposing pistons and a means for converting the reciprocating motion of the pistons into rotational motion of an output member.

2. Description of Related Art

Crucible, or opposing piston engines, such as the *Esso* or *Parsons* Engine are old in the art. They are comprised of, typically, two pairs of opposing pistons, each pair being connected together by a piston rod. The reciprocating motion of the opposing pistons is translated into rotational motion by an elliptic trammel-type linkage or "ellipsograph" mechanism. This rotational, elliptic motion is then transmitted to an output element.

The advantage of these crucible engines is their essential compactness as compared to in-line or V-type engines found in the vast majority of internal combustion engine-powered vehicles today. A four cylinder crucible-type engine can be less than one-half of the length of a standard four cylinder engine. If eight-cylinder (or more) power is desired, the crucible engine can be stacked, such that the output shafts of two engines are linked together. In this manner, an eight cylinder engine could be shorter in length than a standard four cylinder engine.

Another advantage of the crucible engine is it's inherent balance. Conventional in-line or V-type engines have higher order imbalance, which in some cases are countered using balance shafts. These shafts are added at the cost of added complexity. A further advantage of the crucible engine is that, where designed without piston pins, they have fewer bearings. A typical crucible engine has only 10 bearings, versus 13 for a conventional in-line 4-cylinder engine with 5 main bearings. Furthermore, the crucible engine has a comparably short, and thus torsionally stiff crankshaft, relative to its weight. Another advantage exists in the true sinusoidal motion of the piston pairs in a crucible engine incorporating a means of dissipating piston-cylinder side loads. This design simulates a conventional engine with infinitely long connecting rods; such an engine is expected to be between 2 and 6 percent more efficient due to the more even distribution of torque as a function of crank angle. The engine is also expected to run slightly smoother.

As compared to the "Wankel" (rotary) engine, the crucible engine has superior and well known combustion seals and chamber designs, and as such is expected to be more reliable and environmentally cleaner than the "Wankel" engine.

So why aren't crucible engines commonplace today? Because there have been unsolvable problems and complex design solutions associated with the prior designs that lead to early failure and/or expensive manufacturing processes. The implementation of a mechanical valve control system for crucible engines has, historically, been prohibitively complex and costly, but the recent emergence of electromagnetic and electro-hydraulic valve actuators has great potential for a reduction in design complexity.

An overriding problem with the crucible engine has been side loads between the pistons and the cylinder walls. In a conventional in-line or V-type engine, there is very little transverse component to the combustion and centrifugal forces built up in the engine. In the prior crucible engine, however, the crankshaft, in tracing orbital motion while also rotating freely, thereby transferring a large component of the combustion forces from one piston pair to the other. The only escape for these forces has been through the sides of the pistons. Since the piston-cylinder arrangement is designed to accept force only along the axis of reciprocation, these "side loads" can be catastrophic to the lifespan of the prior crucible engine. As such, what is needed is a crucible-type engine that captures and dissipates the piston-cylinder side loads due to combustion forces.

SUMMARY OF THE INVENTION

In light of the aforementioned problems associated with the prior devices, it is an object of the present invention to provide an internal combustion engine or the like which is more efficient. It is a further object to provide such an engine that reduces piston and cylinder wear. It is another object that the present invention be lightweight and compact and be dynamically balanced. It is a further object that the present invention include means for dynamically dissipating the side load forces between the pistons and cylinders originating from the combustion forces and to efficiently capture the inertia and centrifugal forces created by the pistons and associated members. It is another object to provide embodiments of the present invention that comprise both intersecting and non-intersecting cylinder axis', and including embodiments having 2, 3 or 4 pistons. It is a still further object of the present invention to provide an internal combustion engine or the like which can be manufactured easily and inexpensively.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Improved Internal Combustion Engine.

Figure 1:
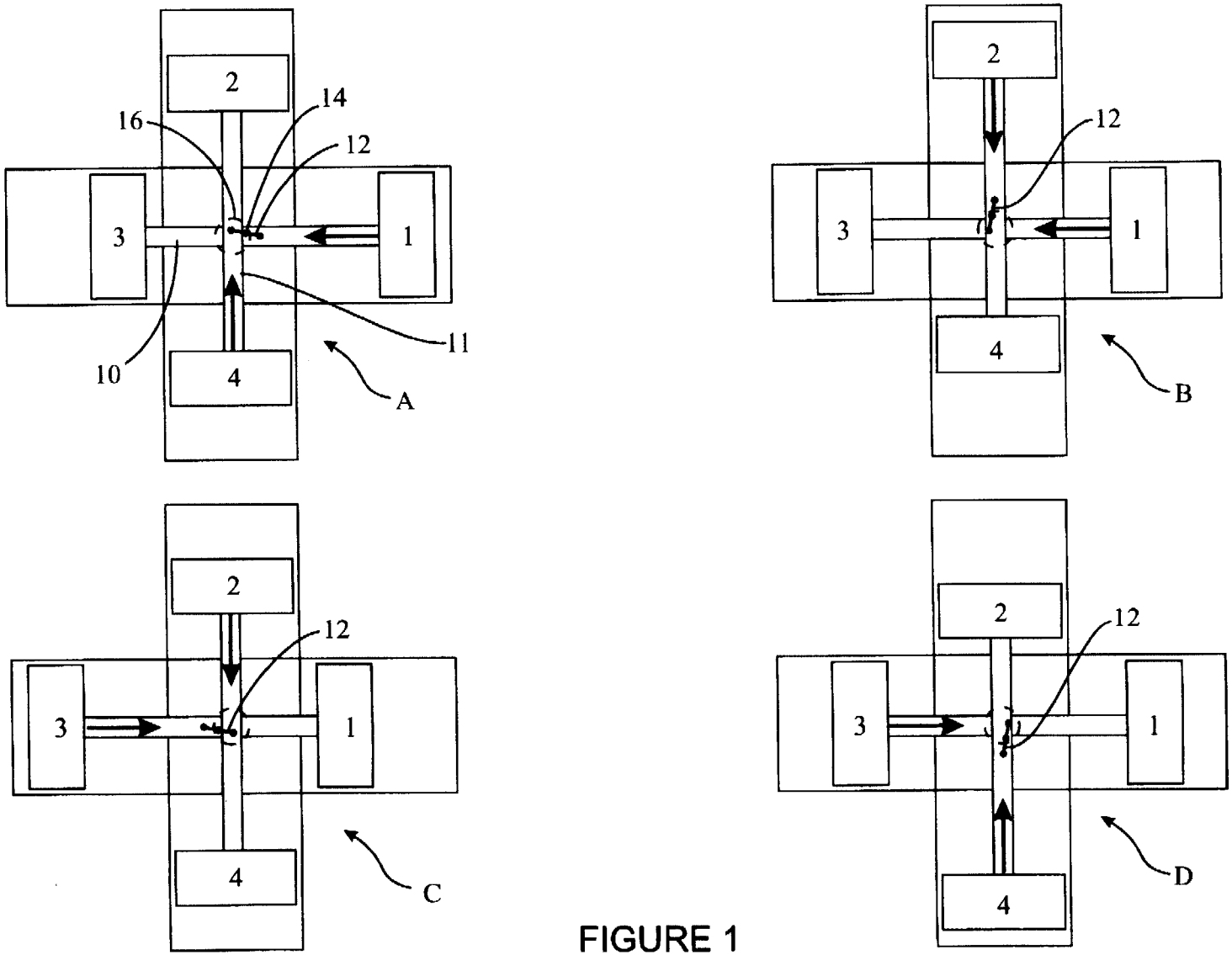
FIG. 1 is a series of schematic views to demonstrate the orbital path of the flying crank of the present invention.

The present invention can best be understood by initial consideration of FIG. 1. FIG. 1 is a series of schematic views to demonstrate the orbital path of the flying crank of the present invention (not shown). As can be seen in view "A", in a generic way, pistons 1 and 3 are opposing each other and connected by a connecting member 10. Also depicted in view "A" is the 2–4 piston pair, opposing each other and connected to one another by the connecting member 11. As can be seen, the axis' of reciprocation of the 2–4 piston pair is perpendicular to that of the 1–3 piston pair. Preliminarily, one must realize that this is simply a schematic representation in order to demonstrate the functioning of the major components of the present invention.

It should be obvious that the linkage 12 cannot actually connect the two connecting members 10 and 11, however if one could connect the center of connecting member 10 to the center of connecting member 11 by linkage 12, the linkage 12 would rotate around its center 14 while it orbits around the path 16. In view "A", piston 1 has just begun it's "downward" (relative to it's stroke) motion. At this time, the 2–4 piston pair is just past the middle of it's travel.

View "B" is one step past view "A". As can be seen, piston 2 has reached the "top" of its travel and is just beginning to "descend". The 1–3 piston pair is now just past the middle of its travel. Furthermore, the linkage 12 has rotated 90 degrees clockwise.

View "C" is one step past view "B". As can be see, piston 3 has just begun its "descent" and piston pair 2–4 is at the middle of its travel. Linkage 12 has rotated 90 degrees clockwise from its position in view "B".

Finally, view "D" is one step past view "C". In view "D", piston 4 has begun its "descent" and piston pair 1–3 is midway in its travel. Linkage 12 has rotated another 90 degrees.

Considering the linkage center 14 in the sequence of views, one can appreciate that it will travel around the path 16, while also rotating in the opposite direction, which in this case, is clockwise.

Figure 2:
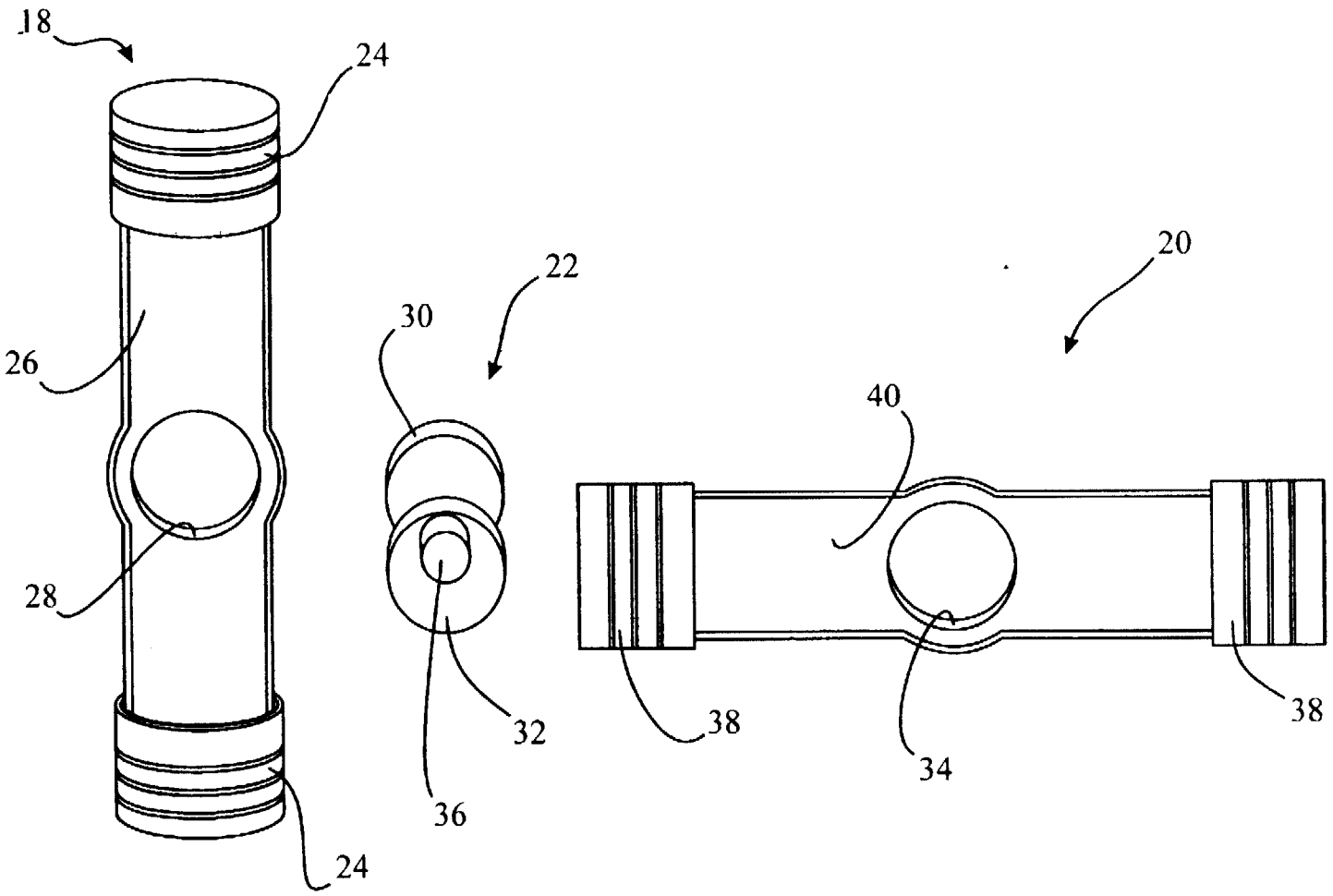
FIG. 2 is an exploded perspective view of two piston pairs and a flying crank of the present invention.

Turning, now to FIG. 2, we shall be first introduced to the novel piston-crank arrangement of the present invention. FIG. 2 is an exploded perspective view of two piston pairs 18 and 20 and a flying crank 22 of the present invention. Each piston pair 18, for example, comprises a pair of pistons 24 connected by a connecting member 26. The materials for the pistons 24 and connecting member 26 are conventional types of lightweight, strong and temperature-resistant materials found in other engines.

Centered between the pair of pistons 24 is a crank aperture 28. The crank aperture 28 might also be configured to accept a bearing (not shown) to reduce the friction between the connecting member 26 and the rotating flying crank 22.

In its elemental form, the flying crank 22 comprises two lobes 30 and 32 that are offset around the center of rotation of the flying crank 22. The lobes 30 and 32 are preferably substantially circular in shape and are configure to fit into the corresponding crank aperture. For example, lobe 30 might fit into crank aperture 28, while lobe 32 fits into crank aperture 34 of piston pair 20. The outer surface of the lobes 30 and 32 is preferably hardened and polished so as to provide a suitable surface for a journal bearing (not shown). Extending axially from the flying crank 22 may be an output member 36 from which output power is taken.

Figures 3A, 3B, 3C, 3D:
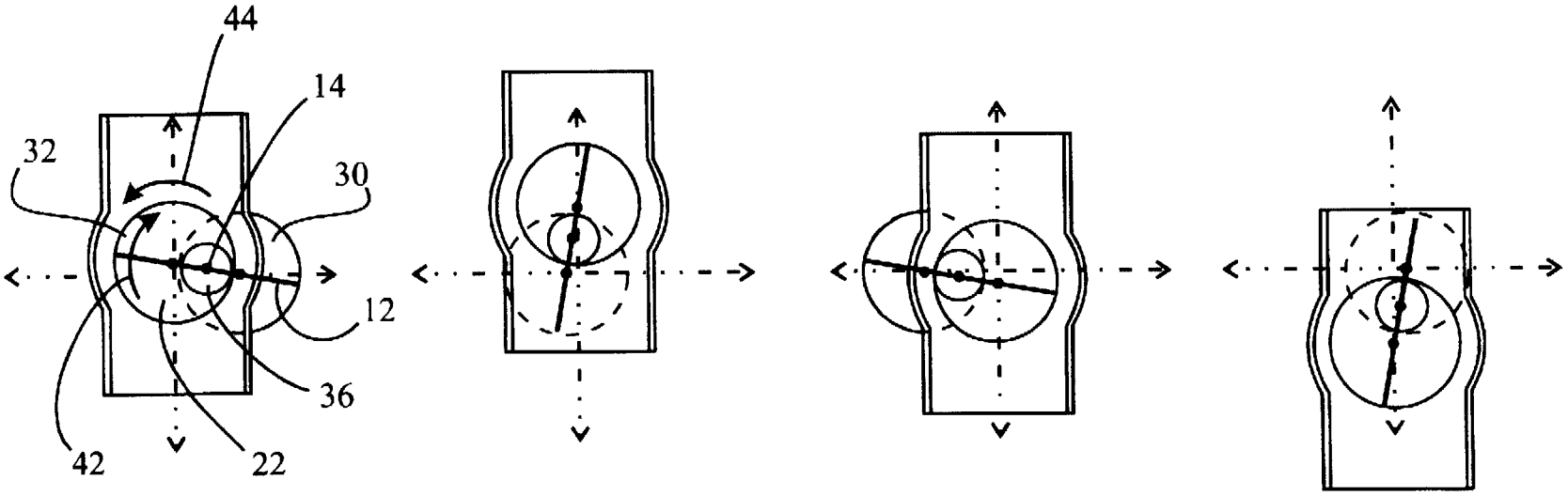
FIG. 3 is a series of side views illustrating the orbital and rotational motions of the flying crank and output member of the present invention.

Piston pair 20 is preferably comprised of opposing pistons 38 rigidly (typically) connected to one another by connecting member 40. As in connecting member 26, connecting member 40 also comprises a crank aperture 34 therethrough for acceptance of lobe 32, for example. When assembled, therefore, piston pair 18 may be aligned generally vertically, piston pair 20 would then be aligned generally horizontally, and the flying crank 22 would rotate around the "z" axis (not depicted). One should appreciate that FIG. 3 depicts four cylinders in two pairs. It is possible that the present invention comprise a variety of different configurations, including a single piston, a single piston pair, and also more than two piston pairs, depending upon the desired application for the engine system.

Now considering FIG. 3 and FIG. 1 simultaneously, one might appreciate how the flying crank 22 duplicates the theoretical motion of the linkage 12. FIG. 3 is a series of side views illustrating the orbital and rotational motions of the flying crank 22 and output member 36 of the present invention. As can be understood by comparing views "A", "B", "C" and "D" in FIGS. 1 and 3, the direction of rotation 42 of the output member 36 is clockwise, where the direction of orbit 44 of the output member 36 is counter-clockwise, just as demonstrated in FIG. 1. Also critical to the functioning of the present invention is the fact that a shaft with a diameter equal to the distance between the outer pivot points of the linkage will perform a perfect non-slip circular orbital rolling motion in a circle twice its diameter (the center of the orbitbeing located on the Z axis).

Figure 4B:
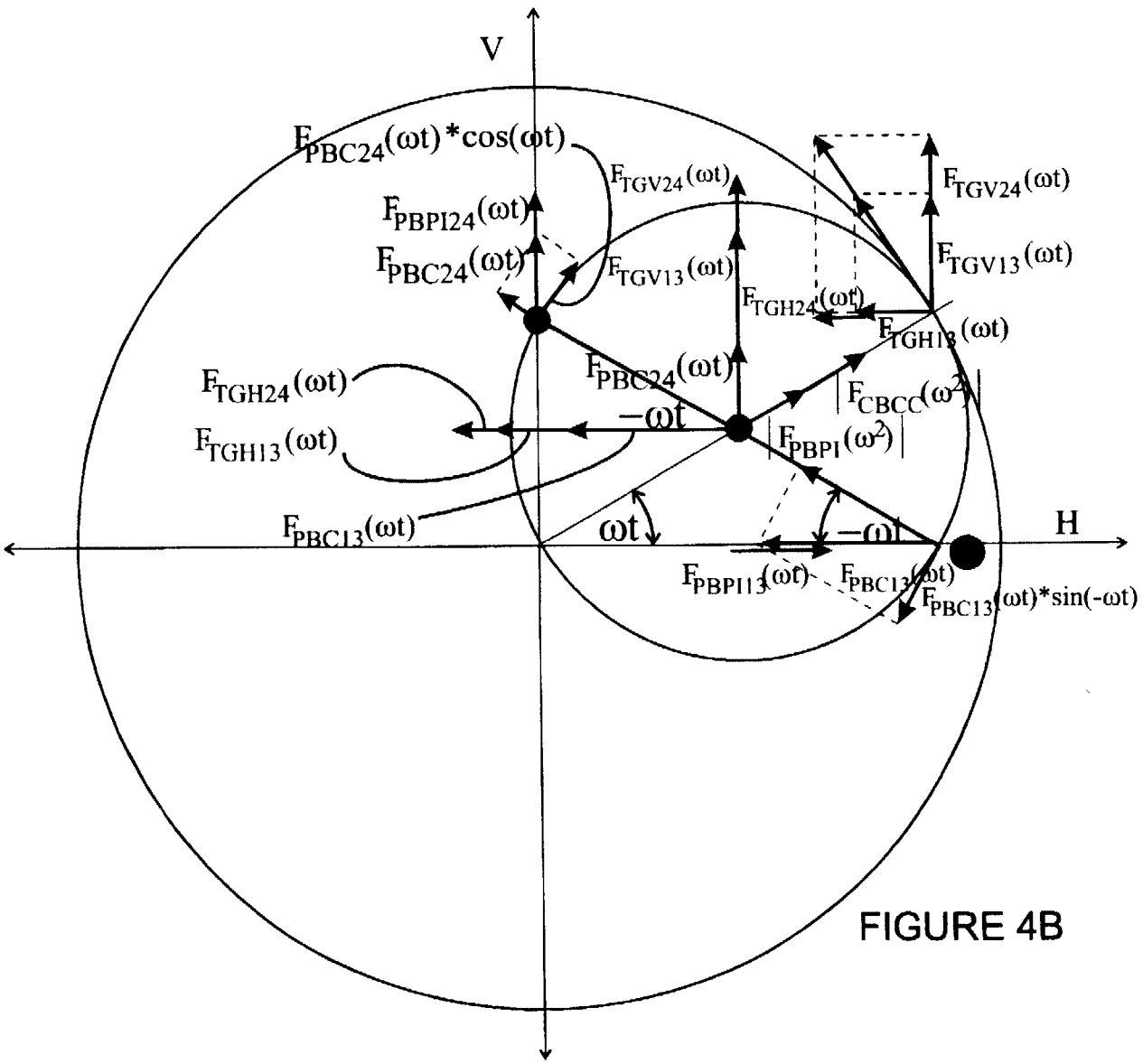
FIG. 4 is a series of illustrations depicting the force distributions on the flying crank, mid-bearing ring and planetary gear areas of the present invention.
Figure 4A:
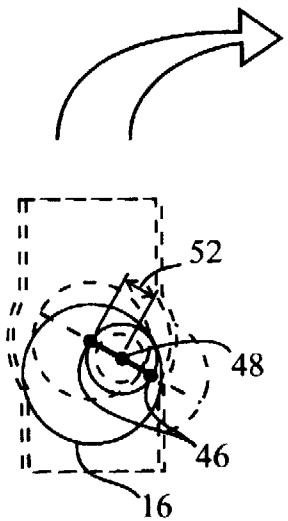

FIG. 4 provides detail of how the present invention functions to substantially dissipate or capture the side loads between the pistons and cylinders. FIG. 4 is a series of illustrations depicting the force distributions on the flying crank, mid-bearing ring and planetary gear areas of the present invention. View "A" shows how the output member follows the orbit path 16, and how the piston bearings 46 and crank bearing 48 are oriented during such travel. View "B" is an enlargement of view "A" to more adequately depict the main forces incident upon the flying crank 22 of the present invention. The three active contributions to the flying crank 48 forces are: the oscillations of the pistons (see equation (1)), the combustion forces (see equation (2)), the centrifugal force of the crank mass and components (see equation (4)), and the most important reactive forces are the tangential gear forces (see equation (6)), where:

$F_{PBC13}(\omega t)$ is the resulting force component on the piston bearing for piston-pair 1–3 due to combustion pressure on pistons 1 and 3; $=ReF_{PBC}(\omega t)$.

$F_{PBC24}(\omega t)$ is the resulting force component on the piston bearing for piston pair 2–4 due to combustion pressure on pistons 2 and 4; $=ImF_{PBC}(\omega t)$.

$F_{TGH13}(\omega t)$ is the horizontal component of the tangential gear force due to combustion forces from the 1–3 piston pair.

$$=ReF_{PBC}(\omega t)*\sin^2(\omega t)$$

$F_{TGV13}(\omega t)$ is the vertical component of the tangential gear force due to combustion forces from the 1–3 piston pair.

$$=ReF_{PBC}(\omega t)*\cos(\omega t)*\sin(-\omega t)$$

$F_{TGH24}(\omega t)$ is the horizontal component of the tangential gear force due to combustion forces from the 2–4 piston pair $$=ImF_{PBC}(\omega t)*\cos(\omega t)*\sin(-\omega t)$$

$F_{TGV24}(\omega t)$ is the vertical component of the tangential gear force due to combustion forces from the 2–4 piston-pair.

$ImF_{PBC}(\omega t)*\cos^2(\omega t)$ $F_{PBPI13}(\omega t)$ is the inertia force component on the piston bearing due to the oscillation of the 1–3 piston pair; $=ReF_{PBPI}(\omega t)$.

$F_{PBPI24}(\omega t)$ is the inertia force component on the piston bearing due to the oscillation of the 2–4 piston-pair; $=ImF_{PBPI}(\omega t)$.

$|F_{PBPI}(\omega^2)|$ is the magnitude of the inertia force on the crank bearing due to the oscillation of both piston-pairs. The direction is always radial.

$F_{CBCC}(\omega^2)|$ is the magnitude of the centrifugal force on the crank bearing due to the orbital motion of the flying crank and its components. The direction is always radial.

These forces are calculated as such:

Piston Bearing Loads

Since most of the motions are circular and perpendicular and can be described with simple geometry, it is appropriate to use complex numbers.

If the planetary gear engagement and the crank bearing tolerance is properly designed, the load on the piston bearings will only be along the cylinder axis (i.e. no side-load) and be equal to the cylinder pressure difference of opposing combustion chambers times the piston area plus the acceleration of the piston pair times its mass:

$$F_{PBPI}(\omega t)=\frac{Mp}{9.81}*2*R*0.0254*\omega^2*(\cos(\omega t)+i\sin(\omega t))=\frac{Mp}{193}*R*\omega^2*(\cos(\omega t)+i\sin(\omega t)). \quad (1)$$

$$F_{PBC}(\omega t)=B^2*\frac{\pi}{4}*\left\{Cpr(\omega t-\pi)-Cpr(\omega t)+i\left[Cpr\left\langle\omega t-\frac{7*\pi}{2}\right\rangle-Cpr\left\langle\omega t-\frac{5*\pi}{2}\right\rangle\right]\right\} \quad (2)$$

$$F_{PB}(\omega t)=F_{PBPI}(\omega t)+F_{PBC}(\omega t) \quad (3)$$

where:

$F_{PBPI}(\omega t)$ is the force on the piston bearings due to the acceleration and mass of the piston pair expressed as a complex number; the real part acts only on the horizontal piston pair, and the imaginary part acts only on the vertical piston pair.

$F_{PBC}(\omega t)$ is the force on the piston bearings due to the combustion pressure expressed as a complex number; the real ($ReF_{PBC}(\omega t)$) part acts only on the horizontal piston pair, and the imaginary ($ImF_{PBC}(\omega t)$) part acts only the vertical piston pair.

B is the cylinder bore.

$\omega t$ is the crank angle $\theta$ expressed as the product of time and angular velocity.

$Cpr(\omega t)$ is the combustion pressure as a function of crank angle, which is an empirically tabulated periodic function (with a period of $4\pi$ for a 4-stroke configuration).

Mp is the mass of one piston pair

R is defined in View A (element 52); piston stroke is 4*R $F_{PB}(\omega t)$ is the resulting force on the piston bearings being the complex sum of the inertia and combustion forces. Again, the real and imaginary parts act only on the horizontal and vertical piston pair, respectively.

[units are in inches, PSI, pounds, radians and radians/sec to negate the need for other constants]

Crank Bearing Loads (As Seen From the Block)

The formula for the centrifugal forces on the crank bearing caused by the orbital motion of the flying crank then becomes:

$$F_{CBCC}(\omega t) = \frac{Mc}{9.81}*R*0.0254*\omega^2*[\cos(\omega t)+i\sin(\omega t)] = \frac{Mc}{386}*R*\omega^2*[\cos(\omega t)+i\sin(\omega t)] \quad (4)$$

$F_{CBCC}(\omega t)$ is the force on the crank bearing due to the crank's centrifugal force, expressed as a complex number.

Mc is the mass of the flying crank 22 with components.

The forces on the crank bearings (i.e. on the near and far sides of the lobes 30 and 32) as seen from the engine block are the vector sum of the piston bearing forces (equation (1)) and the gear forces distributed to each crank bearing with the ratio corresponding to the offset of the pistons and the attack point of the bearings, plus the centrifugal force of the crank shaft distributed evenly between the crank bearings (i.e. on the near and far sides of the lobes 30 and 32). The crank bearing 48 loads and tangential gear loads caused by the combustion and inertia forces from the pistons are decomposed into tangential and radial forces relative to the flying crank 22. The tangential gear force is decomposed again into horizontal and vertical components, which are added to the piston bearing 46 forces to give the horizontal and vertical components of the crank bearing 48 forces. The pistons (and the cylinders) are assumed to be offset (i.e. the lobes are side-by-side), resulting in an uneven load on the two crank bearings (the near bearing 48 is depicted), but since the offset masses of the two pistons and crank eccentrics are balanced out (see additional components in FIGS. 6 and 7), only the combustion forces contribute to the uneven load of the two crank bearings.

Under the assumption of even load from the front and back of the engine, the crank bearing and gear forces can be written as follows:

Near Crank bearing force $$F_{CBN}(\omega t)=0.5*\left\{\begin{array}{l} F_{PBPI}(\omega t)+F_{CBCC}(\omega t)+ \\ \left[1+\frac{ofs}{L_{CB}}\right]*\langle ReF_{PBC}(\omega t)*(1+\sin^2(\omega t))+ImF_{PBC}(\omega t)*\cos(\omega t)*\sin(-\omega t)\rangle+ \\ i\left[1-\frac{ofs}{L_{CB}}\right]*\langle ImF_{PBC}(\omega t)*(1+\cos^2(\omega t))+ReF_{PBC}(\omega t)*\cos(\omega t)*\sin(-\omega t)\rangle \end{array}\right\} \quad (5a)$$

-continued

Far Crank bearing force $$F_{CBF}(\omega t) = 0.5 * \left\{ \begin{array}{l} F_{PBPf}(\omega t) + F_{CBCC}(\omega t) + \\ \left[ 1 - \frac{ofs}{L_{CB}} \right] * \langle ReF_{PBC}(\omega t) * (1 + \sin^2(\omega t)) + ImF_{PBC}(\omega t) * \cos(\omega t) * \sin(-\omega t) \rangle + \\ i \left[ 1 + \frac{ofs}{L_{CB}} \right] * \langle ImF_{PBC}(\omega t) * (1 + \cos^2(\omega t)) + ReF_{PBC}(\omega t) * \cos(\omega t) * \sin(-\omega t) \rangle \end{array} \right\}, \quad (5b)$$

where:

$F_{CBN}(\omega t)$ and $F_{CBF}(\omega t)$ are the forces in the near crank bearing 48 and the car crank bearing (not shown)

ofs is the offset, or distance between the center of gravity of the piston pairs along the flying crank 22 axis.

$L_{CB}$ is the distance between the attack point of the near crank bearing 48 (e.g. 2–4 piston pair) and the far crank bearing (e.g. 1–3 piston pair).

Tangential Gear Forces

Figure 6:
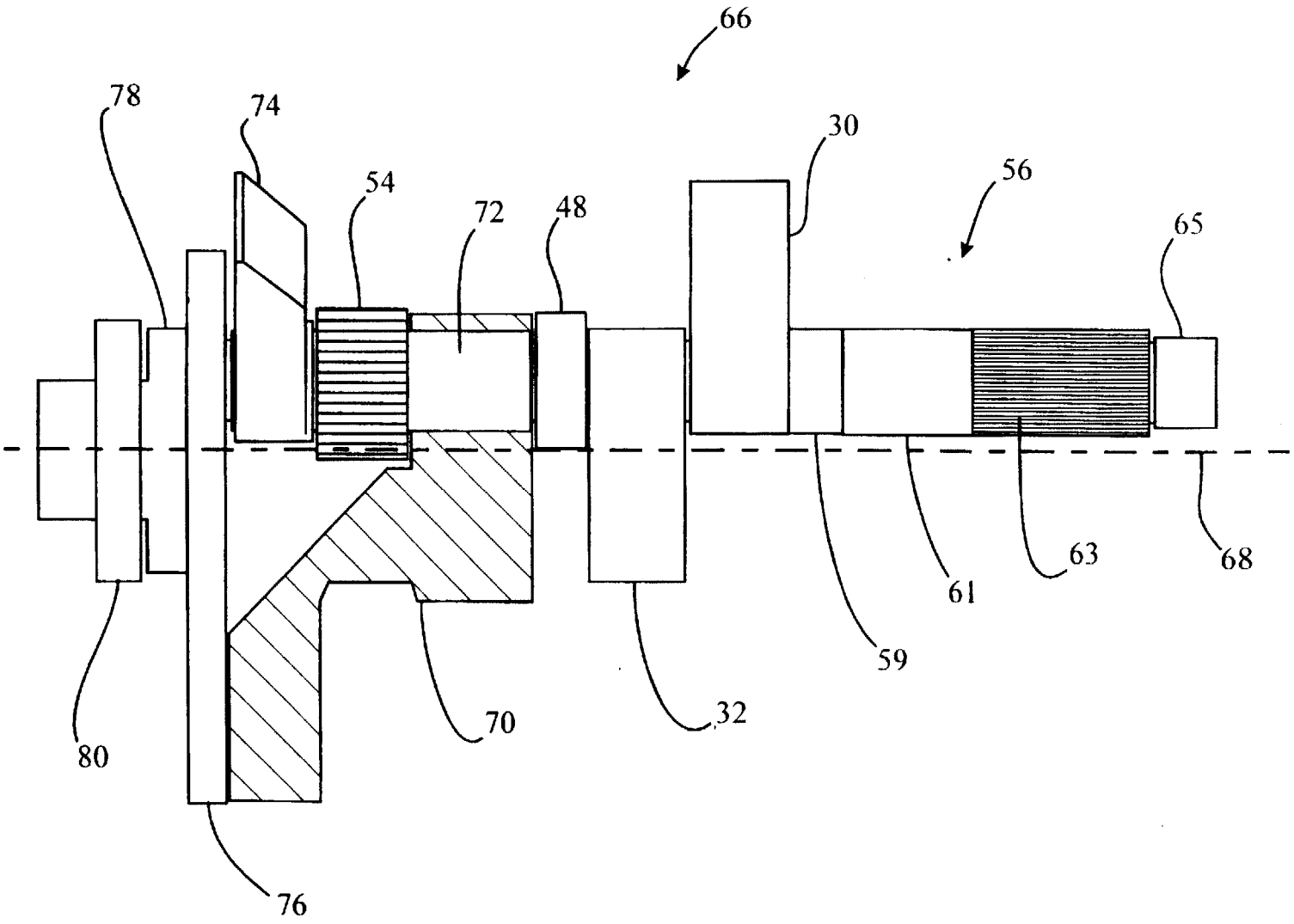
FIG. 6 is a partial cutaway side view of a partially assembled embodiment of the flying crankshaft assembly of the present invention.

Considering FIG. 4 in combination with FIG. 6, one may appreciate an additional feature of the present invention; that of the planet gears 54, for example, near the distal ends of the flying crankshaft 56. The planet gears 54, for example, will aid in the dissipation of the piston side-load forces as they orbit and rotate inside their respective ring gears (not shown). The effects of manufacturing tolerances and/or wear will result in a continuing re-distribution of forces between the crank bearings and the planet gears, while still preventing the formation of side-load forces on the pistons; this is a further strength of the present invention.

Near Gear tangential force $$F_{GN}(\omega t) = 0.5 * \left\{ \left[ 1 + \frac{ofs}{L_G} \right] * ReF_{PBC}(\omega t) * \sin(-\omega t) + \left[ 1 - \frac{ofs}{L_G} \right] * ImF_{PBC}(\omega t) * \cos(\omega t) \right\} \quad (6a)$$

Far Gear tangential force $$F_{GF}(\omega t) = 0.5 * \left\{ \left[ 1 - \frac{ofs}{L_G} \right] * ReF_{PBC}(\omega t) * \sin(-\omega t) + \left[ 1 + \frac{ofs}{L_G} \right] * ImF_{PBC}(\omega t) * \cos(\omega t) \right\}, \quad (6b)$$

where:

$F_{GN}(\omega t)$ and $F_{GF}(\omega t)$ are the forces in the near planet gear 54 and the far planet gear (not shown)

$L_{CB}$ is the distance (along the axis of the flying crankshaft 56) between the two planet gears.

Through careful examination of View "B", one might understand a critical aspect of the present invention. If, for example, an external load was imposed on the output shaft of the present invention while combustion was in progress in, for example, the right cylinder, the center pivot point (corresponding to View "A", element 48) of the linkage (see FIGS. 1 and 2) would be static, but the linkage would be free to rotate. Correspondingly, the flying crank (see FIG. 3) would be orbitally static, but free to rotate in place. It is this rotation that transfers the combustion forces from one piston-pair to the other piston-pair and forces both piston-pairs against the cylinder walls. In the dynamic situation, the same phenomena occurs with a lesser external load.

A critical aspect of this invention is the application of a planetary gear with a ring gear-to-planet gear tooth count ratio of 2:1. This arrangement will dissipate moments created in the linkage directly to the block, while performing the same rotational and orbital motion. By proper design of the backlash of the gear, and the clearances and tolerances of the bearings, pistons and cylinders, it is possible to eliminate the aforementioned side forces. It should particularly be realized that the near and far half cranks are keyed in synchronous motion through the gears and bearings.

It should also be understood from Equation (1), that the inertia of the piston-pairs combine to a vector having a magnitude proportional to the angular velocity squared, with a direction defined by the intersection of the horizontal and vertical axis' and the center pivot point (i.e. View "A", element 48), thus presenting a constant radial force similar to the centrifugal forces caused by the orbit of the flying crankshaft (see FIG. 3) with its components quantitatively expressed in Equation (4). It must further be appreciated that these radial forces can easily be transferred directly to the block from the flying crankshaft (see FIG. 3) via a frictionless roller or other bearing having a diameter of approximately 2*R.

Figure 5:
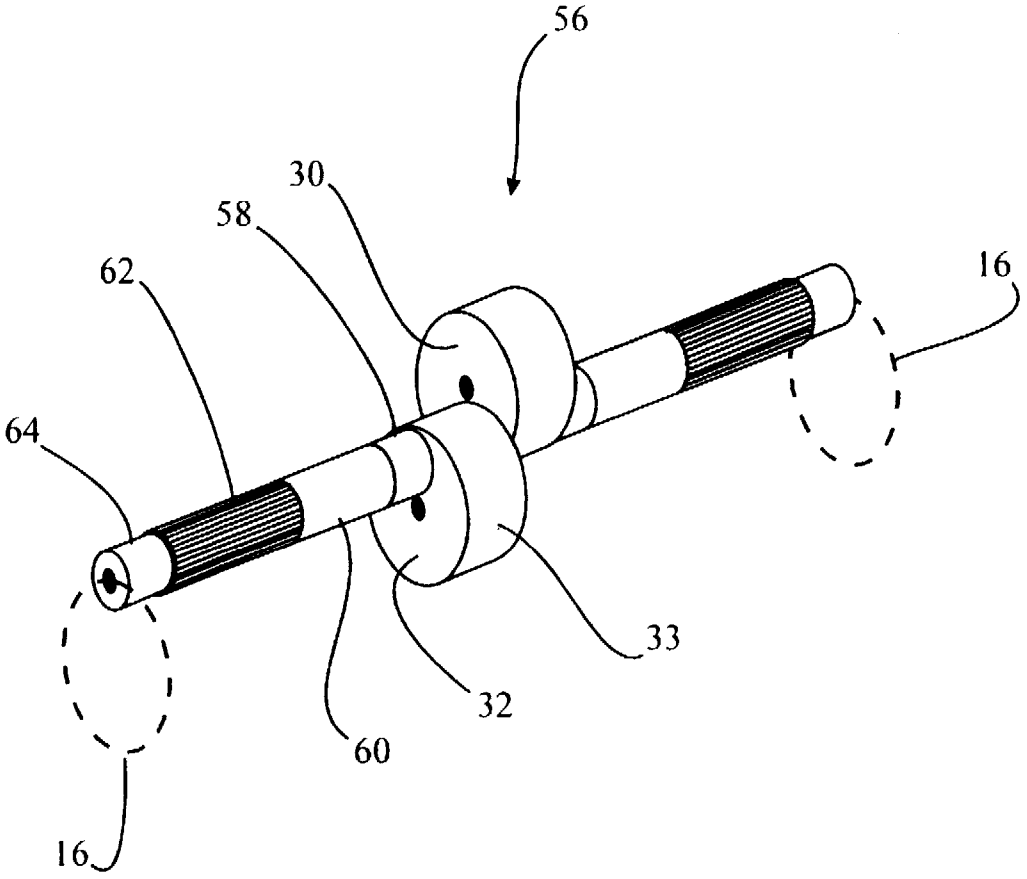
FIG. 5 is a perspective view of a preferred flying crankshaft of the present invention.

Having adequately discussed the novel and nonobvious force distribution of the present invention, we shall now turn to FIG. 5 to continue the description of the entire system of the present invention. FIG. 5 is a perspective view of a preferred flying crankshaft 56 of the present invention. The flying crankshaft 56 depicted here is merely an expansion upon the flying crank 22 of the previous figures; the orbiting path 16 of the flying crankshaft 56 is the same as that described in connection with the flying crank 22.

In its preferred form, the flying crankshaft 56 is formed from standard materials into an elongated shaft having various features to provide for the attachment of other devices, as discussed below in connection with FIGS. 6 and 7. As shown, only the "near side" features are discussed; in most cases, the identical features will be present on the "far side" of the flying crankshaft 56.

On the outer surface of the near lobe 32 is preferably a piston journal 33, suitably prepared to retain a bearing or the like. Adjacent to the near lobe 32 is the near bearing seat 58, where the near crank bearing (see FIG. 4) would reside. The crank bearings (see FIG. 4) are preferably of a roller-type bearing, or any other suitable improvement thereon. If the engine block had been shown, one would see a journal formed therein to correspond to the orbit path 16 described at the near bearing seat 58, for supporting the near crank bearing (see FIG. 6) as it orbits.

Adjacent to the near bearing seat 58 may be a shaft journal 60, where a half crank bearing (see FIGS. 6 and 7) may reside. Next along the crankshaft 56 is a set of splines 62 upon which items which must be engaged rotationally with the flying crankshaft 56 may reside, such as a balance weight and planet gear (see FIGS. 6 and 7).

Figure 7A:
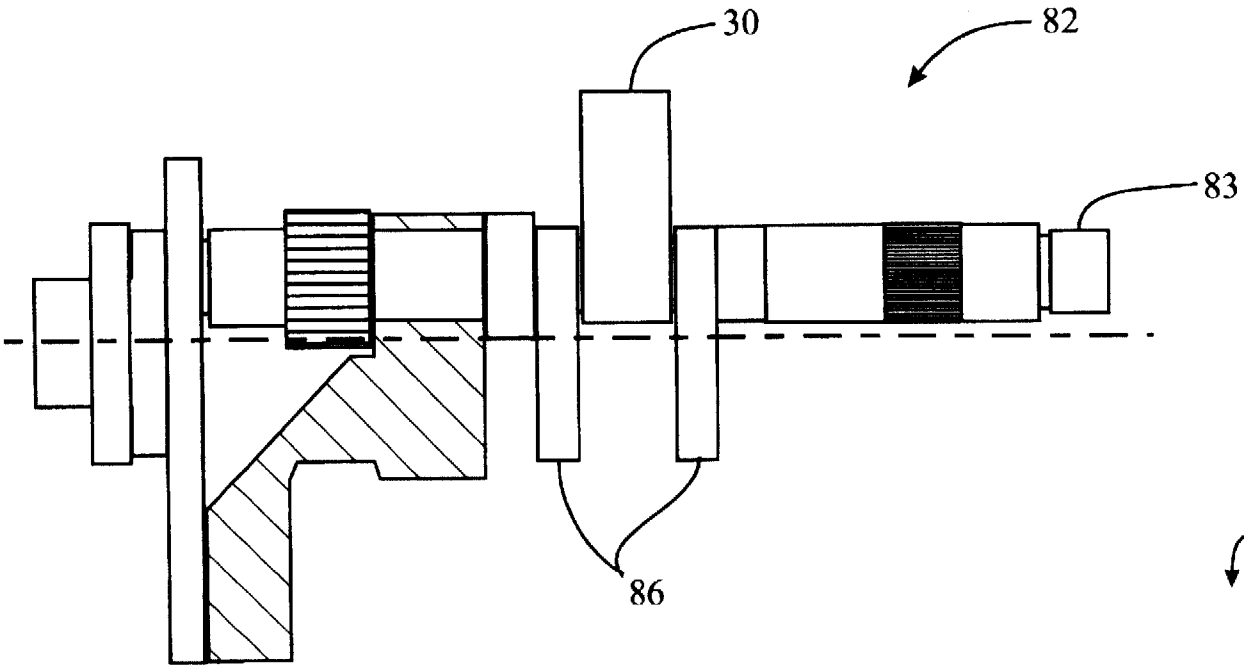
FIG. 7 is a partially assembled, partial cutaway side view of another embodiment of the flying crankshaft assembly of the present invention and a perspective view of a corresponding preferred piston pair.
Figure 7B:
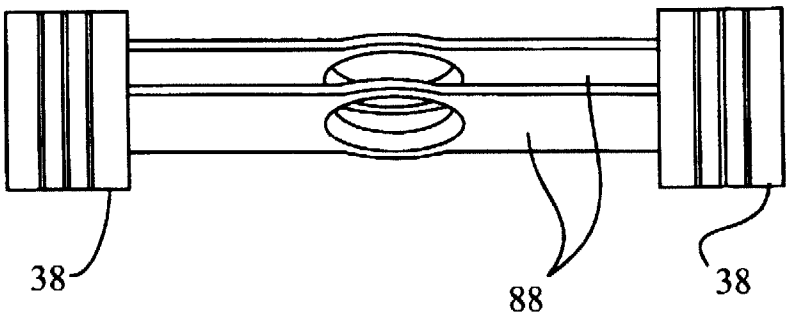

Finally, adjacent to the splines 62 may be an end bearing journal 64 upon which an end bearing may be place for engagement with a connector plate (see FIGS. 6 and 7). As will be apparent below in connection FIGS. 6 and 7, the end bearing—connector plate—half crank arrangement will provide support and dissipation for any axial and bending forces that may build up along the flying crankshaft 56.

Other arrangements, dimensions and sequences are possible for the features of the flying crankshaft 56, depending upon the particular application for which the engine is designed; the aforementioned layout is merely exemplary of the present invention.

Now considering FIG. 6, one may fully appreciate the novel and nonobvious flying crankshaft assembly 66 of the present invention. FIG. 6 is a partial cutaway side view of a partially assembled embodiment of the flying crankshaft assembly 66 of the present invention. After first reviewing the exposed flying crankshaft 56 features, we shall proceed to discussing the devices that attach thereon.

Traveling "backwardly" from the far lobe 30, we have a far bearing journal 59, a far shaft journal 61, far splines 63 and a far end bearing journal 65. The far end of the flying crankshaft 56 may attach to a flywheel mount (not shown) via another connector plate (e.g. like element 76) for capture of the inertial forces of orbit of the flying crankshaft assembly 66. One should take note that the flywheel (not shown) and any accessories (not shown) will describe simple rotation, around the centerline of rotation 68, rather than following an orbiting path. It should also be noted that the engine of the present invention can be "stacked" to another engine, for example, by connecting the flywheel mount of one engine to the accessory mount of another.

Now traveling "forwardly", from the near lobe 32, we have the near crank bearing 48, which, as described above in connection with FIG. 4, will be instrumental in dissipating the inertia and centrifugal forces of the piston-pairs and flying crank assembly 66. Adjacent to the near crank bearing 48 is the half crank 70, which rotates due to the orbital motion of the flying crankshaft 56 which in turn rotates in the opposite direction in the near half crank bearing 72. The half crank 70 should also be equipped with an outer bearing journal (not shown) which will correspond with a bearing in the engine block (not shown), to dissipate any radial forces into the block. The half crank 70 will rotate about the centerline of rotation 68.

Adjacent to the half crank 70 is the near planet gear 54, which is pressed over the splines (see FIG. 5), which will prevent relative rotation between the near planet gear 54 and the flying crankshaft 56. On the engine block is mounted a ring gear (not shown) inside which the near planet gear 54 will orbit and rotate. As discussed in connection with FIG. 4, these gears will be instrumental in the dissipation of the side-load forces between the pistons and cylinders. Next to the near planet gear 54 is a balance weight 74, which is pressed onto the flying crankshaft 56 to prevent relative rotation thereon. The balance weight 74 is configured to compensate for the offset intersection between the two piston-pairs.

The next component may be the connector plate 76, which rides over the near end bearing journal (see FIG. 5) to provide additional bending stability and dissipate the axial load through a thrust bearing (not shown). As can be seen, the connector plate 76 is preferably attached to the half crank 70, both of which rotate about the centerline of rotation 68.

The final devices shown in FIG. 6 are the accessory shaft 78 and accessory shaft bearing 80. The accessory shaft rotates about the centerline of rotation 68, and is the preferred takeoff point for the accessory drives, such as the alternator, airconditioning compressor, oil pump, and the like. If assembly constraints could be overcome, the connector plate 76 and accessory shaft 78 and/or the connector plate 76 and half crank 70 could be manufactured from a single piece. It should, once again, be particularly realized that the near and far half cranks are keyed in synchronous motion through the gears and bearings.

Because it might be desirable to further balance the forces within this novel engine, intersecting piston pairs may be utilized, as demonstrated in FIG. 7. FIG. 7 is a partially assembled, partial cutaway side view of another embodiment of the flying crankshaft 82 assembly of the present invention and a perspective view of a corresponding preferred piston pair 84. As can be seen, the near lobe has been reconfigured into a split lobe 86. In such a manner, the forces due to the piston pairs is balanced along the axis of the alternative flying crankshaft 83. In engagement with the split lobe 86 is an alternative piston pair 84, in place of the piston pair 20 (see FIG. 2). As can be seen, the piston pair 84 comprises pistons 38 connected to one another by a split connecting member 88, which is configured to engage the split lobe 86. Furthermore, it should be noticed that when intersecting piston-pairs 84 and 88 are utilized, there is not need for the balance weight (see FIG. 6), which reduces the complexity and weight of this embodiment over that described in connection with FIG. 6.

The reader should appreciate that the piston-pair and crankshaft axis' may not be strictly in the vertical and horizontal planes. For example, the piston-pairs could be aligned in an "X", rather than a "+", depending upon the particular application of the engine. Furthermore, where the crankshaft axis is horizontal, the lower vertical piston (piston 4 in FIG. 1) may have a tendency to trap oil. Another embodiment of the present invention presents a solution to this. Such an embodiment may include three cylinders; a horizontal piston-pair and a single vertical piston coupled to a guided counterweight or pump, etc., configured such that the center of mass of the vertical piston assembly remains at the pivot point. Where the crankshaft axis is vertical, a somewhat unusual gearbox must be attached thereto in order to maintain a low center of gravity. Furthermore, if two adjacent cylinders are converted to a counterweight, etc., and the cylinder axis' are rotated 45 degrees around the horizontal crankshaft axis, a V-shaped two-cylinder configuration that can be stacked will result.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An improved internal combustion engine, comprising:

a block having a first and second cylinder, said first cylinder disposed along a first axis and said second cylinder disposed along a second axis, the second axis in orthogonal alignment with the first axis, and said block further including at least one ring gear means;

a first piston reciprocal in said first cylinder;

a second piston reciprocal in said second cylinder;

a first connecting member attached to said first piston in alignment with said first cylinder and further defined by a first crank aperture;

a second connecting member attached to said second piston in alignment with said second cylinder and further defined by a second crank aperture;

an orbital crankshaft having first and second lobes, said first lobe configured to orbit in said first crank aperture and said second lobe configured to orbit in said second crank aperture, said crankshaft orbital and rotatable about a third axis, and said crankshaft further comprising at least one planetary gear means, each said planetary gear means aligned to engage one said ring gear means and configured such that for every two rotations of said crankshaft, each said planetary gear means completes one orbit around said at least one ring gear means and said ring gear means, planetary gear means, pistons, connecting members, lobes, crankshaft and bearing means being dependently configured to dissipate substantially the entirety of any transverse forces between said pistons and said cylinders; and means, rotatable about the third axis, and extending from said crankshaft, for providing output power from the engine.

2. The engine of claim 1, wherein said crankshaft further comprises at least one bearing journal, and the engine further comprises:

at least one bearing means held in said block along the third axis, adjacent to said first and second lobes and against which said at least one bearing journal is configured to ride, said pistons, connecting members, lobes, crankshaft and bearing means being dependently configured to dissipate substantially the entirety of any transverse forces between said pistons and said cylinders and any centrifugal forces created by reciprocation of said pistons and said connecting members.

3. The engine of claim 2, wherein said dependent configuration of said pistons, connecting members, lobes, crankshaft and bearing means dissipates substantially the entirety of any centrifugal forces created by said crankshaft and said bearing means, and any inertia forces created by reciprocation of said pistons and said connecting members.

4. The engine of claim 3, further comprising:

at least one half crank member, each said half crank member rotatably attached to said orbital crankshaft along the third axis between each said planetary gear means and each said bearing means.

5. The engine of claim 4, further comprising:

at least one balancing member, each said balancing member attached to said orbital crankshaft along the third axis.

6. The engine of claim 5, wherein said orbital crankshaft is further defined by a first end having an end bearing journal formed thereon, and the engine further comprises:

at least one connecting plate member, each said connecting plate rotatably attached to said end bearing journal and further attached to said half crank whereby bending forces on said orbital crankshaft are dissipated.

7. The engine of claim 6 wherein said orbital crankshaft is further defined by a second end and wherein said first end and said second end are configured to transmit power developed in the engine to external components.

8. The engine of claim 6 further comprising a first engine of claim 6 attached to a second engine of claim 6, said first end of said first engine attached to said second end of said second engine, and said orbital crankshaft of said first engine in axial alignment with said orbital crankshaft of said second engine.

9. An improved internal combustion engine, comprising:

a block having a first and second pairs of opposing cylinders, said first cylinder pair disposed along a first axis and said second cylinder pair disposed along a second axis, the second axis in orthogonal alignment with the first axis;

a first piston pair reciprocal in said first cylinder pair;

a second piston pair reciprocal in said second cylinder pair;

a first connecting means for connecting said first piston pair to each other, extending between said opposing pistons of said first piston pair in alignment with said first cylinder pair and further defined by at least one crank aperture;

a second connecting means for connecting said first piston pair to each other, extending between said opposing pistons of said second piston pair in alignment with said second cylinder pair and further defined by at least one crank aperture;

an orbital crankshaft having first and second crank lobe means for converting reciprocal motion of said first and second connecting means into orbital and rotational motion, said first lobe means configured to orbit in said at least one crank aperture in said first connecting means and said second lobe means configured to orbit in said at least one crank aperture in said second connecting means, said crankshaft orbital and rotatable about a third axis; and means, rotatable about the third axis, and extending from said crankshaft, for providing output power from the engine.

10. The engine of claim 9, wherein:

said block further includes at least one ring gear means;

said crankshaft further comprises at least one planetary gear means, each said planetary gear means aligned to engage one said ring gear means and configured such that for each rotation of said crankshaft in a rotation direction, each said planetary gear means completes one orbit inside said at least one ring gear means in an orbit direction, said orbit direction being opposite to said rotation direction, and said ring gear means, planetary gear means, pistons, connecting means, lobes, crankshaft and bearing means being dependently configured to dissipate substantially the entirety of any transverse forces between said pistons and said cylinders.

11. The engine of claim 10, wherein said crankshaft further comprises at least one bearing ring, and the engine further comprises:

at least one bearing means held in said block along the third axis, adjacent to said first and second lobe means and against which said at least one bearing ring is configured to ride, said pistons, connecting means, lobe means, crankshaft and bearing means being dependently configured to dissipate substantially the entirety of any inertia forces created by reciprocation of said pistons and said connecting means and any centrifugal forces created by said crankshaft.

12. The engine of claim 11, further comprising:

at least one half crank member, each said half crank member rotatably attached to said orbital crankshaft along the third axis between each said planetary gear means and each said bearing means;

at least one balancing member, each said balancing member attached to said orbital crankshaft along the third axis.

13. The engine of claim 12, wherein said orbital crankshaft is further defined by a first end and a second end, each said end having an end bearing journal formed thereon, and the engine further comprises:

at least one connecting plate member, each said connecting plate rotatably attached to said one end bearing journal and further attached to said half crank whereby bending forces on said orbital crankshaft are dissipated.

14. The engine of claim 13 further comprising a first engine of claim 13 attached to a second engine of claim 13, said first end of said first engine attached to said second end of said second engine, and said orbital crankshaft of said first engine in axial alignment with said orbital crankshaft of said second engine.

15. The engine of claim 13, wherein:

said first lobe means comprises a first lobe having two opposing sides;

said second lobe means comprises two half-lobes adjacent and on either said side of said first lobe along the third axis; and said second connecting means comprises a pair of parallel connecting members extending between each piston of said second piston pair, each connecting member further defined by a crank aperture formed therethrough, each for engagement with one said half-lobe.

16. In an engine, the combination comprising:

a block having a first and second pairs of opposing cylinders, said first cylinder pairs disposed along a first axis and said second cylinder pairs disposed along a second axis, the second axis in orthogonal alignment with the first axis;

a first piston pair reciprocal in said first cylinder pair;

a second piston pair reciprocal in said second cylinder pair;

a first connecting means for connecting said first piston pair to each other, extending between said opposing pistons of said first piston pair in alignment with said first cylinder pair and further defined by at least one crank aperture;

a second connecting means for connecting said first piston pair to each other, extending between said opposing pistons of said second piston pair in alignment with said second cylinder pair and further defined by at least one crank aperture;

an orbital crankshaft having first and second crank lobe means for converting reciprocal motion of said first and second connecting means into orbital and rotational motion, said first lobe means configured to orbit in said at least one crank aperture in said first connecting means and said second lobe means configured to orbit in said at least one crank aperture in said second connecting means, said crankshaft orbital and rotatable about a third axis; and means, rotatable about the third axis, and extending from said crankshaft, for providing output power from the engine.

17. The combination of claim 16, wherein:

said block further includes at least one ring gear means;

said crankshaft further comprises at least one planetary gear means, each said planetary gear means aligned to engage one said ring gear means and configured such that for each rotation of said crankshaft in a rotation direction, each said planetary gear means completes one orbit inside said at least one ring gear means in a orbit direction, said orbit direction being opposite to said rotation direction, and said ring gear means, planetary gear means, pistons, connecting means, lobes, crankshaft and bearing means being dependently configured to dissipate substantially the entirety of any transverse forces between said pistons and said cylinders.

18. The combination of claim 17, wherein said crankshaft further comprises at least one bearing ring, and the engine further comprises:

at least one bearing means held in said block along the third axis, away from said first and second lobe means and against which said at least one bearing ring is configured to ride, said pistons, connecting means, lobe means, crankshaft and bearing means being dependently configured to dissipate substantially the entirety of any inertia forces created by reciprocation of said pistons and said connecting means and any centrifugal forces created by said crankshaft.

19. The combination of claim 18 further comprising a first engine of claim 18 attached to a second engine of claim 18, said first end of said first engine attached to said second end of said second engine, and said orbital crankshaft of said first engine in axial alignment with said orbital crankshaft of said second engine.

20. The combination of claim 18, wherein:

said first lobe means comprises a first lobe having a pair of opposing sides;

said second lobe means comprises two half-lobes adjacent and on either said side of said first lobe along the third axis; and said second connecting means comprises a pair of parallel connecting members extending between each piston of said second piston pair, each connecting member further defined by a crank aperture formed therethrough, each for engagement with one said half-lobe.

* * * * *